US011827863B2

(12) United States Patent
Marsh et al.

(10) Patent No.: US 11,827,863 B2
(45) Date of Patent: Nov. 28, 2023

(54) MARINE ENGINE LUBRICATION

(71) Applicant: Infineum International Limited, Abingdon (GB)

(72) Inventors: Adam P Marsh, Witney (GB); Jonathan M. Hughes, Abingdon (GB)

(73) Assignee: INFINEUM INTERNATIONAL LIMITED, Abingdon (GB)

( * ) Notice: Subject to any disclaimer, the term of this patent is extended or adjusted under 35 U.S.C. 154(b) by 0 days.

(21) Appl. No.: 15/928,178

(22) Filed: Mar. 22, 2018

(65) Prior Publication Data

US 2018/0273873 A1 Sep. 27, 2018

(30) Foreign Application Priority Data

Mar. 24, 2017 (EP) ..... 17162837

(51) Int. Cl.

| | |
|---|---|
| ***C10M 141/10*** | (2006.01) |
| ***C10M 129/54*** | (2006.01) |
| ***C10M 133/12*** | (2006.01) |
| ***C10M 133/44*** | (2006.01) |
| ***C10M 137/10*** | (2006.01) |
| ***C10M 169/04*** | (2006.01) |
| *C10N 30/04* | (2006.01) |
| *C10N 30/06* | (2006.01) |
| *C10N 30/10* | (2006.01) |
| *C10N 30/00* | (2006.01) |
| *C10N 40/25* | (2006.01) |
| *C10N 60/14* | (2006.01) |

(52) U.S. Cl.

CPC ..... *C10M 141/10* (2013.01); *C10M 129/54* (2013.01); *C10M 133/12* (2013.01); *C10M 133/44* (2013.01); *C10M 137/10* (2013.01); *C10M 169/04* (2013.01); *C10M 2207/262* (2013.01); *C10M 2215/064* (2013.01); *C10M 2215/086* (2013.01); *C10M 2215/26* (2013.01); *C10M 2215/30* (2013.01); *C10M 2219/046* (2013.01); *C10M 2223/045* (2013.01); *C10N 2030/04* (2013.01); *C10N 2030/06* (2013.01); *C10N 2030/10* (2013.01); *C10N 2030/43* (2020.05); *C10N 2030/52* (2020.05); *C10N 2040/25* (2013.01); *C10N 2040/252* (2020.05); *C10N 2060/14* (2013.01)

(58) Field of Classification Search

CPC ..... C10M 2215/30; C10M 2223/045; C10M 2215/26; C10M 2207/262; C10N 2040/26; C10N 2030/52; C10N 2030/10; C10N 2010/04; C10N 2230/04; C10N 2230/06; C10N 2230/10; C10N 2240/10

See application file for complete search history.

(56) References Cited

U.S. PATENT DOCUMENTS

| | | | | |
|---|---|---|---|---|
| 6,599,867 | B2 * | 7/2003 | Hammond | C07C 51/414 508/460 |
| 2008/0167207 | A1 | 7/2008 | Nagamatsu | |
| 2009/0281009 | A1 * | 11/2009 | Van Houten | C10M 129/54 508/287 |
| 2011/0015105 | A1 * | 1/2011 | Davies | C10M 159/22 508/280 |
| 2016/0137949 | A1 * | 5/2016 | Houten | C10M 141/06 123/1 A |
| 2016/0237370 | A1 | 8/2016 | Van Houten | |
| 2016/0340604 | A1 * | 11/2016 | van Houten | C10M 169/045 |

FOREIGN PATENT DOCUMENTS

| | | | |
|---|---|---|---|
| JP | 2002-038569 | A | 9/2002 |
| JP | 2004-081147 | A | 9/2005 |
| JP | 2010-022520 | A | 7/2008 |
| JP | 2010-022520 | A | 8/2011 |
| JP | 2011-234226 | A | 3/2012 |
| JP | 2014-193153 | A | 12/2014 |
| WO | 2016-086857 | A1 | 6/2016 |
| WO | 2016090065 | A1 | 6/2016 |

* cited by examiner

*Primary Examiner* — Vishal V Vasisth

(57) ABSTRACT

A low S marine fuel trunk piston diesel engine lubricant includes an overbased metal detergent; a zinc dihydrocarbyl dithiophosphate; optionally an aminic antioxidant; and a borated ashless dispersant. The lubricant exhibits improved thermal and oxidative stability and improved high temperature detergency.

16 Claims, No Drawings

MARINE ENGINE LUBRICATION

FIELD OF THE INVENTION

This invention relates to the lubrication of four-stroke marine diesel internal combustion engines, usually referred to as trunk piston engines, when fueled by low sulfur fuels. Lubricants therefore are usually known as trunk piston engine oils ("TPEOs").

BACKGROUND OF THE INVENTION

Trunk piston engines may be used in marine, power-generation and rail traction applications, and have a higher speed than cross-head engines. A single lubricant (TPEO) is used for crankcase and cylinder lubrication. All major moving parts of the engine, i.e. the main and big end bearings, camshaft and valve gear, are lubricated by means of a pumped circulation system. The cylinder liners are lubricated partially by splash lubrication and partially by oil from the circulation systems that finds its way to the cylinder wall through holes in the piston skirt via the connecting rod and gudgeon pin.

Driven by health and environmental concerns, there has been increasing interest in the use of low sulfur fuel for the operation of trunk piston engines. It is therefore desirable to provide TPEOs designed for use with low sulfur fuel where the TPEO has a low base number but is capable of providing oxidative stability, viscosity increase control, and improved detergency performance.

EP-A-3 020 790 ("'790") describes such a TPEO but that includes a specific combination of medium and high overbased detergents comprising overbased salts of defined linear alkyl-substituted hydroxybenzoic acids. '790 describes TPEOs that contain aminic anti-oxidants (stated to further improve oxidative stability and viscosity increase control) and zinc dialkyldithiophosphate antiwear agents. '790 states that the TPEOs of its invention do not contain a salt of a sulfonic acid, or a conventional salicylate-based detergent, or a sulfurized metal alkyl phenate.

WO 2016/131929 ("'929") also describes such a TPEO including a specific combination of detergents. It describes TPEOs that contain zinc dialkyldithiophosphate antiwear agents and non-post treated succinimide (i.e. without boron) dispersants.

WO 2016/184897 ("'897") also describes such a TPEO including a specific combination of detergents. It describes TPEOs that contain zinc dialkyldithiophosphate antiwear agents and borated post-treated succinimide dispersants in comparative examples. '897 states that the preferable succinimide does not contain boron.

SUMMARY OF THE INVENTION

The present invention enables the detergents not contained in the TPEOs of the invention of '790 to be successfully used, and in the presence of low amounts of aminic anti-oxidants and zinc dialkyldithiophosphate antiwear agents (thereby reducing cost). This is done by using a defined level of a borated dispersant, borated dispersants not being described in '790.

When a sulfonate detergent is used in the present invention, it is possible to improve high temperature stability and reduce the need for additional additives. Further, use of salicylate/sulfonate detergent combinations makes it possible to improve both oxidation control and high temperature stability.

In a first aspect, the present invention provides a low sulfur marine fuel trunk piston diesel engine lubricating oil composition comprising or made of admixing (A) an oil of lubricating viscosity in a major amount; and, in respective minor amounts (B) an overbased metal detergent comprising a metal salt of a surfactant selected from a hydrocarbyl-substituted phenol, a hydrocarbyl-substituted sulfonic acid, and a hydrocarbyl-substituted hydroxybenzoic acid;

(C) a zinc dihydrocarbyl dithiophosphate in an amount of 50 to 1000 ppm by weight in terms of P content;

(D) optionally, an aminic anti-oxidant in an amount of up to 400 ppm by weight in terms of N content; and (E) a borated ashless dispersant in an amount of 10 to 500 ppm by weight in terms of B content, the composition having a TBN of 5 to less than 20, preferably 8 to 15, mg KOH/g.

In a second aspect, the present invention provides a method for operating a four-stroke trunk piston engine comprising (i) fueling the engine with a low sulfur marine fuel; and (ii) lubricating the engine with a lubricating oil composition of the first aspect of the invention.

Definitions

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means 40 or 50 mass % or more of a composition, preferably 60 mass % or more, even more preferably 70 mass % or more;

"minor amount" means less than 50 mass % of a composition, preferably less than 40 mass %, even more preferably less than 30 mass %;

"TBN" means total base number as measured by ASTM D2896;

a "low sulfur marine fuel" means a fuel having 0.5 wt % or less, 0.5 to 0.05 wt %, or 0.1 to 0.0015 wt % of sulfur relative to the total weight of the fuel, and may be a fuel meeting the specification of a marine distillate fuel set forth in the ISO 8217: 2010 international standard.

Furthermore in this specification, if and when used:

"calcium content" is as measured by ASTM D5185;

"phosphorus content" is as measured by ASTM D5185;

"sulphated ash content" is as measured by ASTM D874;

"sulphur content" is as measured by ASTM D2622;

"boron content" is as measured by ASTM D5185;

to "nitrogen content" is as measured by ASTM D5762;

"zinc content" is as measured by ASTM D5185;

"kV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Oil of Lubricating Viscosity (A)

The lubricant composition contains a major proportion of an oil of lubricating viscosity. Such lubricating oils may range in viscosity from light distillate mineral oils to heavy lubricating oils. Generally, the viscosity of the oil ranges from 2 to 40, such as 3 to 15, $mm^2$/sec, as measured at 100° C., and a viscosity index of 80 to 100, such as 90 to 95. The lubricating oil may comprise greater than 60, typically greater than 70, mass % of the composition.

Natural oils include animal oils and vegetable oils (e.g., castor oil, lard oil); liquid petroleum oils and hydro refined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogues and homologues thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from esterification and used without further treatment are unrefined oils.

The American Petroleum Institute (API) publication "Engine Oil Licensing and Certification System", Industry Services Department, Fourteenth Edition, December 1996, Addendum 1, December 1998 categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

The present invention can be used with all of the above base oils. The present invention is particularly suited to oils containing greater than or equal to 90% saturates and less than or equal to 0.03% sulphur as the oil of lubricating viscosity, e.g. Group II, III, IV or V. They also include basestocks derived from hydrocarbons synthesised by the Fischer-Tropsch process. In the Fischer-Tropsch process, synthesis gas containing carbon monoxide and hydrogen (or 'syngas') is first generated and then converted to hydrocarbons using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. The syngas may, for example, be made from gas such as natural gas or other gaseous hydrocarbons by steam reforming, when the basestock may be referred to as gas-to-liquid ("GTL") base oil; or from gasification of biomass, when the basestock may be referred to as biomass-to-liquid ("BTL" or "BMTL") base oil; or from gasification of coal, when the basestock may be referred to as coal-to-liquid ("CTL") base oil.

Preferably, the oil of lubricating viscosity in this invention contains 50 mass % or more said basestocks. It may contain 60, such as 70, 80 or 90, mass % or more of said basestock or a mixture thereof. The oil of lubricating viscosity may be substantially all of said basestock or a mixture thereof.

A TPEO may employ 5-35, preferably 7-20, more preferably 12-15, mass % of a concentrate or additives package, the remainder being base stock.

Preferably, the TPEO has a compositional TBN (using D2896) of 7-30, such as 7-20, most preferably 8-15.

The following may be mentioned as typical proportions of additives in a TPEO.

| Additive | Mass % a.i. (Broad) | Mass % a.i. (Preferred) |
|---|---|---|
| detergent(s) | 0.5-12 | 2-8 |
| dispersant(s) | 0.5-5 | 1-3 |
| anti-wear agent(s) | 0.1-1.5 | 0.5-1.3 |
| oxidation inhibitor | 0.1-2 | 0.5-1.5 |
| rust inhibitor | 0.03-0.15 | 0.05-0.1 |
| pour point dispersant | 0.03-1.15 | 0.05-0.1 |
| base stock | balance | balance |

These proportions are, however, modified in the present invention in accordance with the limitations stated herein.

The TBN of the TPEO of the invention is in the range of 5 to less than 20, such as 5 to 18, such as 8 to 15.

Overbased Metal Detergents (B)

A detergent is an additive that reduces formation of deposits, for example, high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

A detergent comprises a polar head with a long hydrophobic tail. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The detergent is preferably an alkali metal or alkaline earth metal additive such as an overbased oil-soluble or oil-dispersible calcium, magnesium, sodium or barium salt of a surfactant selected from phenol, sulphonic acid and hydroxybenzoic acid, wherein the overbasing is provided by an oil-insoluble salt of the metal, e.g. carbonate, basic carbonate, acetate, formate, hydroxide or oxalate, which is stabilised by the oil-soluble salt of the surfactant. The metal of the oil-soluble surfactant salt may be the same or different from that of the metal of the oil-insoluble salt. Preferably the metal, whether the metal of the oil-soluble or oil-insoluble salt, is calcium. The acids are hydrocarbyl-substituted, such as alkyl-substituted, as is known in the art.

The TBN of the detergent may be low, i.e. less than 50 mg KOH/g, medium, i.e. 50-150 mg KOH/g, or high, i.e. over 150 mg KOH/g, as determined by ASTM D2896. Preferably the TBN is medium or high, i.e. more than 50 TBN. More preferably, the TBN is at least 60, more preferably at least 100, more preferably at least 150, and up to 500, such as up to 350 mg KOH/g, as determined by ASTM D2896.

The soap mass in the TPEO may be 0.1 to 4, such as 0.4 to 3.3, mass %. Preferably, the surfactant is in the form of a hydroxybenzoic acid such as a hydrocarbyl-substituted salicylic acid. The surfactant may be a single acid, a mixture of acids, or a complex of different acids. Advantageously, the detergent may be a mixture of a salicylate and a sulfonate.

Zinc Dihydrocarbyldithiophosphate (C)

Dihydrocarbyl dithiophosphate metal salts may be prepared in accordance with known techniques by first forming a dihydrocarbyl dithiophosphoric acid (DDPA), usually by reaction of one or more alcohols or a phenol with $P_2S_5$ and then neutralizing the formed DDPA with a metal compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the metal salt, any basic or neutral metal compound could be used but the oxides, hydroxides and carbonates are most generally employed. Commercial additives frequently contain an excess of metal due to the use of an excess of the basic metal compound in the neutralization reaction.

At least 50 mole % of component (C) is a zinc alkyl dithiophosphate where the alkyl group is a $C_6$ primary alkyl group and may be represented by the following formula:

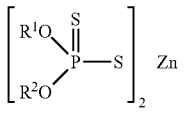

wherein $R^1$ and $R^2$ may be the same or different and are primary alkyl groups containing 6 carbon atoms, such as n-hexyl.

Preferably, at least 60, at least 70, at least 80, or at least 90, mole % of component (C) is the zinc dialkyl dithiophosphate. More preferably, all of component (C) is the zinc dialkyl dithiophosphate.

Preferably, (C) constitutes 50 to 800, such as 100-800, such as 100-500, or 50 to 500 such as 200-400, ppm by weight in terms of P content of the TPEO. (C) may be a primary and/or secondary zinc dialkyldithiophosphate.

Aminic Antioxidant (D)

As examples of aminic antioxidants there may be mentioned secondary aromatic amines such as diarylamines, for example diphenylamines wherein each phenyl group is alkyl-substituted with an alkyl group having 4 to 9 carbon atoms.

Preferably, the anti-oxidant is provided in the composition in an amount of 10-400, such as 10-300, such as 10-200, such as 50-200, ppm by weight in terms of N content. In an embodiment of the invention, such as anti-oxidant is not present.

Borated Ashless Dispersant (E)

Ashless dispersants are non-metallic organic material that form substantially no ash on combustion. They comprise a long chain hydrocarbon with a polar head, the polarity being derived from inclusion of e.g., an O, P or N atom. The hydrocarbon is an oleophilic group that confers oil-solubility and has, for example 40-500 carbon atoms. Thus, ashless dispersants may comprise an oil-soluble polymeric backbone having functional groups that are capable of associating with particles to be dispersed.

Noteworthy, examples of ashless dispersant are succinimides, e.g., polyisobutene succinic anhydride and polyamine condensation products.

In this invention, borated ashless dispersants are used in order to provide the defined boron content. Preferably, it is 10-200, such as 10-150, such as 50-150, ppm by weight in terms of B content.

Other additives such as other dispersants, pour point depressants, anti-foamants, metal rust inhibitors, and/or demulsifiers may be provided, if necessary.

The terms 'oil-soluble' or 'oil-dispersable' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions of this invention comprise defined individual (i.e. separate) components that may or may not remain the same chemically before and after mixing.

It may be desirable, although not essential, to prepare one or more additive packages or concentrates comprising the additives, whereby the additives can be added simultaneously to the oil of lubricating viscosity to form the lubricating oil composition. Dissolution of the additive package (s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package (s) is/are combined with a predetermined amount of base lubricant.

Thus, the additives may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations may typically contain about 5 to 40 mass % of the additive packages(s), the remainder being base oil.

EXAMPLES

The present invention is illustrated by, but not limited to, the following examples.

Preparations

Three trunk piston engine oils (TPEOs) were blended to comprise one or more of

- a Group I base oil
- a succinimide dispersant
- an overbased calcium salicylate detergent
- a zinc dialkyldithio phosphate anti-wear agent (ZDDP)
- an alkylated diphenyl amine anti-oxidant (DPA)

These components were identical except that examples of the invention (1 and 2) each contained a borated succinimide dispersant whereas a comparison example (A) contained a non-borated dispersant.

The compositions of the three TPEOs are set out in the table below.

TABLE 1

| | A (comparison) | 1 | 2 |
|---|---|---|---|
| TBN | 13.56 | 13.36 | 13.21 |
| ppm B | 0 | 120 | 120 |
| ppm N from DPA | 260 | 180 | 180 |
| ppm N from dispersants | 250 | 320 | 250 |
| ppm P from ZDDP | 550 | 360 | 350 |
| ppm Zn from ZDDP | 610 | 390 | 390 |

The main differences are that Examples 1 and 2 each contain B whereas Example A does not; and that Example 1 and 2 contain less DPA and less ZDDP than Example A.

Testing and Results

Each of compositions A, 1 and 2 was subjected to three tests:

- the Komatsu Hot Tube Test (KHTT) which is a lubrication industry bench test that measures the degree of high temperature detergency and thermal and oxidative stability of a lubricating oil. The test was carried out at 320° C. and results are expressed as a rating where a higher number indicates a better performance.
- the Differential Scanning Calorimeter Test (PDSC) is used to evaluate the evaluate the thin film oxidative stability of lubricating oils and is carried out in accordance with ASTM D-6186. Tests were carried at 210° C. and results expressed in time (in minutes) at which the oxidation of the oils starts. Thus, a greater time indicates a better performance.
- The GFC Oxidation Test is carried out in accordance with GFC Tr-21-A-90. PAI (peak area increase) is measured after 216 hours, % KV100 increase measured also after 216 hours, and % TBN remaining after 216 hours calculated. Lower figures indicate better performance.

The results are summarized in the table below.

Tests

| | | | GFC | | |
|---|---|---|---|---|---|
| Examples | KHTT | P DSC | PAI | % KV 100 increase | TBN Change |
| A | 0 | 21.8 | 507.5 | 60.5 | −7.3 |
| 1 | 2 | 25.0 | 317.10 | 31.30 | −5.9 |
| 2 | 1.5 | 25.0 | 321.30 | 32.50 | −5.8 |

In the results, the examples of the invention (1 and 2), which contained B and lower levels of ZDDP and DPA, gave better performance in all of the tests than the comparative example (A).

A second set of TPEOs was prepared and tested.

Preparations

Five TPEO's were blended to comprise one or more of

- a Group I base oil
- a succinimide dispersant
- an overbased calcium salicylate and/or an overbased calcium sulfonate detergents
- a zinc dialkylthiophosphate anti-wear agent (ZDDP)

optionally, an alkylated diphenylamine anti-oxidant (DPA).

The compositions of the five TPEO's are set out in the table below, examples B and C being comparison examples and examples 3-5 of the invention.

TABLE 2

| | B (comparison) | C (comparison) | 3 | 4 | 5 |
|---|---|---|---|---|---|
| TBN metal detergent | 11.9 salicylate | 11.9 salicylate | 12.1 sulfonate | 11.9 Salicylate and sulfonate | 14.9 Salicylate and sulfonate |
| soap level (mass %) | 1.53 | 1.123 | 1.085 | 1.49 | 1.747 |
| ppm B | 0 | 78 | 78 | 65 | 59 |
| ppm N from DPA | 260 | 0 | 50 | 0 | 0 |
| ppm N from dispersant | 250 | 310 | 240 | 210 | 240 |
| ppm P from ZDDP | 896 | 560 | 320 | 352 | 387 |
| ppm Zn from ZDDP | 985 | 616 | 352 | 388 | 425 |

Testing and Results

Each of the five compositions was subjected to the KHTT and GFC Oxidation Test as described and also to the high frequency reciprocating rig test (HFRR) described as follows.

Samples of the above formulations were tested using a PCS Instruments high frequency reciprocating rig (HFRR) on a standard protocol comprising the following conditions:

15 minutes

20 Hz reciprocation of 1 mm stroke length 400 g load using standard equipment manufacturer-supplied steel substrates 80° C. to 380° C. at 20° C. per minute The temperatures reported (in ° C.) were taken from the point at which a consistent frictional response is no longer received from the test sample (onset of scuffing), as measured by the HFRR equipment software. Once this has occurred, the oil is deemed to no longer be able to provide sufficient wear protection. Onset of scuffing correlates to minimum friction coefficient. Higher results are better.

The results are summarized in the table below.

| Examples | KHTT | HFRR | PAI | % kV100 increase | TBN change |
|---|---|---|---|---|---|
| B | 0 | 295 | 636 | 111 | 37 |
| C | 0 | 290 | 560 | 86 | 40 |
| 3 | 3 | >375 | 505 | 71 | 40 |
| 4 | 2 | 354 | 429 | 34 | 60 |
| 5 | 1.5 | 361 | 450 | 36 | 65 |

In the results, B-containing and lower ZDDP-level examples of the invention (3-5) performed better and the presence of Ca sulfonate in Examples 4 and 5 gave rise to improved performance; in particular, improved high temperature stability and improved oxidation resistance.

What is claimed is:

1. A low sulfur marine fuel trunk piston diesel engine lubricating oil composition comprising or made of admixing (A) a Group I base oil in a major amount; and in respective minor amounts;

(B) an overbased detergent consists essentially of an overbased calcium salicylate and an overbased calcium sulfonate; wherein the soap level of the composition is from 1.49 to 1.747 mass %;

(C) a primary and/or secondary zinc dialkyldithiophosphate in an amount of 352 to 387 ppm by weight in terms of P atoms;

the aminic antioxidant is an alkylated diphenylamine;

(D) a borated ashless dispersant comprising a borated succinimide and is present in an amount of 50 to 65 ppm by weight in terms of B atoms; and wherein the TBN of the composition is from 11.9 to 15 mg KOH/g; and wherein the composition is essentially free of aminic antioxidant.

2. The composition of claim 1, wherein the composition exhibits three or more of the following characteristics:

a Komatsu Hot Tube Test (KHTT) score at 320° C. of at least 1.5;

a peak area increase (PAI) after 216 hours in a GFC Oxidation Test of less than 505;

a % KV100 increase after 216 hours in a GFC Oxidation Test of less than 60.5;

a % TBN remaining after 216 hours in a GFC Oxidation Test of greater than 40; and a wear protection temperature, as measured using a High Frequency Reciprocating Rig (HFRR), of greater than 295° C.

3. The composition of claim 2, wherein the composition exhibits four or more of the characteristics.

4. The composition of claim 2, wherein the composition exhibits a peak area increase (PAI) after 216 hours in a GFC Oxidation Test of 361 or less, a % KV100 increase after 216 hours in a GFC Oxidation Test of 36 or less, and/or a wear protection temperature, as measured using HFRR, of 354° C. or higher.

5. The composition of claim 3, wherein the composition exhibits a peak area increase (PAI) after 216 hours in a GFC Oxidation Test of 361 or less, a % KV100 increase after 216 hours in a GFC Oxidation Test of 36 or less, and/or a wear protection temperature, as measured using HFRR, of 354° C. or higher.

6. A method for operating a four-stroke trunk piston engine comprising the steps of:

(i) providing the engine fueled with a low sulfur marine fuel; and (ii) lubricating the engine with a lubricating oil composition as claimed in claim 1.

7. The method of claim 6 where the low sulfur marine fuel is a distillate fuel.

8. The method of claim 6 where the fuel has a sulfur content of equal to or less than 0.5 mass % in terms of S atoms of sulfur.

9. The method of claim 6 where the low sulfur marine fuel is a distillate fuel and the fuel has a sulfur content of equal to or less than 0.5 mass % in terms of S atoms of sulfur.

10. A method for operating a four-stroke trunk piston engine comprising the steps of:

(i) providing the engine fueled with a low sulfur marine fuel; and (ii) lubricating the engine with a lubricating oil composition as claimed in claim 2.

11. A method for operating a four-stroke trunk piston engine comprising the steps of:

(i) providing the engine fueled with a low sulfur marine fuel; and (ii) lubricating the engine with a lubricating oil composition as claimed in claim 3.

12. A method for operating a four-stroke trunk piston engine comprising the steps of:

(i) providing the engine fueled with a low sulfur marine fuel; and (ii) lubricating the engine with a lubricating oil composition as claimed in claim 4.

13. A method for operating a four-stroke trunk piston engine comprising the steps of:

(i) providing the engine fueled with a low sulfur marine fuel; and (ii) lubricating the engine with a lubricating oil composition as claimed in claim 5.

14. The composition of claim 2, wherein the composition exhibits a Komatsu Hot Tube Test (KHTT) score at 320° C. of up to 3.

15. The composition of claim 1, wherein the composition exhibits three or more of the following characteristics:

a Komatsu Hot Tube Test (KHTT) score at 320° C. of at least 1.5;

a peak area increase (PAI) after 216 hours in a GFC Oxidation Test of less than 505;

a % KV100 increase after 216 hours in a GFC Oxidation Test of less than 71;

a % TBN remaining after 216 hours in a GFC Oxidation Test of greater than 40; and a wear protection temperature, as measured using a High Frequency Reciprocating Rig (HFRR), of greater than 295° C.

16. The composition of claim 15, wherein the composition exhibits four or more of the characteristics.

* * * * *